US006461043B1

(12) United States Patent
Healy et al.

(10) Patent No.: US 6,461,043 B1
(45) Date of Patent: Oct. 8, 2002

(54) RECLOSABLE BAG

(75) Inventors: Steven Michael Healy; Thomas Heaslip, both of Topeka, KS (US)

(73) Assignee: Colgate Palmolive Company, New York, NY (US)

( * ) Notice: Subject to any disclaimer, the term of this patent is extended or adjusted under 35 U.S.C. 154(b) by 0 days.

(21) Appl. No.: 09/577,107

(22) Filed: May 24, 2000

(51) Int. Cl.[7] ..... B65D 33/34

(52) U.S. Cl. ..... 383/204; 383/5; 383/61; 383/64; 383/103; 383/120

(58) Field of Search ..... 383/5, 61, 63, 383/64, 204, 120, 103, 107

(56) References Cited

U.S. PATENT DOCUMENTS

| | | | | | |
|---|---|---|---|---|---|
| 4,491,959 | A | | 1/1985 | Loefberg | |
| 5,037,138 | A | * | 8/1991 | McClintock et al. | 383/61 X |
| RE34,347 | E | * | 8/1993 | Van Erden et al. | 383/63 |
| 5,364,189 | A | * | 11/1994 | Kuge et al. | 383/61 |
| 5,669,715 | A | | 9/1997 | McManus et al. | |
| 5,788,378 | A | * | 8/1998 | Thomas | 383/64 X |
| 5,833,791 | A | | 11/1998 | Bryniarski et al. | |
| 5,919,535 | A | | 7/1999 | Dobreski et al. | |
| 6,030,123 | A | * | 2/2000 | Mitarai | 383/63 |
| 6,132,089 | A | * | 10/2000 | Galomb et al. | 383/61 X |
| 6,186,663 | B1 | * | 2/2001 | Ausnit | 383/64 X |
| 6,213,645 | B1 | * | 4/2001 | Beer | 383/61 X |
| 6,261,000 | B1 | * | 7/2001 | Bois | 383/107 X |

FOREIGN PATENT DOCUMENTS

| | | | | | |
|---|---|---|---|---|---|
| DE | 200 08 403 | U1 | | 7/2000 | |
| JP | 404006049 | A | * | 1/1992 | 383/120 |
| JP | 405097151 | A | * | 4/1993 | 383/61 |
| JP | 0 812 776 | A2 | | 12/1997 | |
| JP | 0 834 454 | A1 | | 4/1998 | |
| NL | 1 592 905 | A | | 7/1981 | |
| WO | WO 98/24339 | | | 6/1998 | |
| WO | WO 98/24702 | | | 6/1998 | |

* cited by examiner

*Primary Examiner*—Jes F. Pascua
(74) *Attorney, Agent, or Firm*—Michael J. McGreal

(57) ABSTRACT

The reclosable bag has a gusset side structure so that the bag can be self-supporting on its bottom surface. The reclosable structure can be an internal structure or an external structure. As an external structure the front and rear walls extend above the reclosable seal and are bonded together above the reclosable seal. This extended wall structure is removed to remove these tamper evident seal. If within the bag the tamper evident seal is composed of a loop of film extending downward from each side of the reclosable seal to seal the contents of the bag. This loop must be broken to open the bag. The preferred reclosable seal is a zipper with bonded stays or each end to maintain the zipper on the bag. The bag has diagonal seals at the lower corners for forming a flat bottom to the bag and at the upper corners to provide vents for pressure equalization. The bags are made by a process where all processing is on line except for forming the zipper which is constructed off-line. The zipper is added in the machine direction and the gusset sidewalls in the cross-direction. At the end of the bag making line they are severed and printed. The bags can be immediately filled.

9 Claims, 7 Drawing Sheets

RECLOSABLE BAG

FIELD OF THE INVENTION

This invention relates to a reclosable bag that has a gusset structure which provides a base when filled for supporting the reclosable bag in an upright position. This invention further relates to a reclosable bag which has a tamper evident seal over the reclosable fastener.

BACKGROUND OF THE INVENTION

There is a need for reclosable bags for products that are used in partial amounts and which need to be isolated from the atmosphere after the bag is opened. A usable resealable unit is a zipper-type of seal where the bag can be opened and reclosed. The bags usually will have a permanent seal above the zipper-type of seal that serves to secure the bag until it is opened. This permanent seal can be an extension of the front wall and rear wall that is sealed together above the zipper-type seal. In order to open such a bag the front and rear wall is cut above the zipper-type seal and removed to expose the zipper-type seal. Also, there may be a perforation above the zipper-type seal to assist in removing part or all of the front or rear wall to expose the zipper-type reclosable seal.

The prior art for bags with zipper-type of seals is set out in U.S. Pat. No. 5,833,791, U.S. Pat. No. 5,919,535 and PCT Application WO98/24339. U.S. Pat. No. 5,833,791 discloses a zipper-type of seal with a particular end stop to keep the zipper from sliding off the track. These end stops must be of a strength so as to secure the slides throughout the period of use. U.S. Pat. No. 5,919,535 discloses a bag with a zipper-type of seal where each of the zipper-type lock segments have fin pieces which attach to the front and rear walls of the bag. PCT Application WO98/24339 discloses a zipper-type of seal with a perforated area above the zipper-type seal to facilitate opening of the bag. The slide zipper seal is maintained in a closed position until part of the front and/or rear wall is removed to expose the primary slide zipper seal for the opening of the bag.

These bags and the resealable closures are very useful. However, other features are necessary in various bags. These include features to make the bags easier to fill, close after filling, and stack for shipping, storage and display at the point of sale. The present invention is directed to reclosable bags that are easily and quickly filled, can be vented, and have improved storage and handling features.

BRIEF DESCRIPTION OF THE INVENTION

The invention comprises a reclosable bag that has a slide zipper reclosable seal at one end. The bag is comprised of a front wall and a rear wall with two sidewalls connecting the front wall to the rear wall. Each sidewall has a gusset structure. The upper end of the bag is closed with a reclosable slide zipper seal and in a first embodiment with the front and rear wall extending above the reclosable slide zipper seal and attached to each other above this seal to enclose the reclosable slide zipper seal. In a further embodiment the slide zipper reclosable seal may be at the top edge of the bag. The bag is open at the bottom for bottom filling and after bottom filling is sealed.

In the first embodiment where the front and/or rear wall extends above the reclosable slide zipper seal there can have a perforation extending essentially parallel to the slide zipper seal to facilitate the opening of the enclosure of the slide zipper seal. This enclosure functions as a tamper-evident seal for the primary zipper-type seal since it must be removed in order to open the bag.

In the further embodiment the slide zipper reclosable seal is attached to a top edge of the bag with the tamper evidency formed within the bag by a loop of film attached to each side of the zipper. This loop of film must be severed in order to open the bag and remove any of the contents.

The bag has a narrowed opening at the bottom to assist in the filling of the bag. At the bottom edge the end portions are bonded together to form this narrowed opening. This is a bonding of the front and rear walls through the sidewall gussets. This bonding is enhanced by apertures in at least one of the gusset walls so that there is a bonding of a bonding layer of a film to another film surface. And in a further preferred embodiment the inwardly folded gussets are tack welded to either the front or rear wall so that they do not interfere with the insertion of a filling tube into the bag.

In a preferred embodiment the reclosable bag has a seal adjacent to each corner of the reclosable bag. These seals reduce the volume of the bag and at the bottom of the reclosable bag enhance the gusset sidewall self-supporting feature and at the upper portion of the reclosable bag keep product from the ends of the slide zipper seals, but have at least one passage therethrough for venting the bag. In a yet further preferred embodiment these seals are generally diagonal seals at the corners.

Adjacent the upper end the bag there is at least one vent so as to equalize the air pressure in the bag and the external air pressure such as when the filled bags are being stacked on pallets for shipping. This at least one vent is formed by at least one small opening adjacent the slide zipper seal. The upper corner seals prevent product from accumulating at a vent and to minimize liquids wicking through the vents.

The reclosable bag is made by unwinding a film, usually a rear wall film, bondable side facing up. Preformed gusset tubes with a bondable exterior surface are attached to this film in a cross direction. A preformed reclosable slide zipper seal is bonded to the this film and attached gusset tubes at an upper portion thereof and a another film, usually the front wall film, bondable side facing downward is attached to the slide zipper reclosable seal and to the gusset sidewalls. In a further step, seals are formed adjacent the corners of the reclosable bag decreasing the volume of the bag, the seals at an end of the bag adjacent the reclosable slide zipper seal having a at least one passage therethrough for venting of the reclosable bag. The reclosable bag has a vent opening to the bag exterior adjacent the ends of the reclosable slide zipper seal to equilibrate the pressure in the bag with the exterior pressure. A prime advantage is when the bags are compressed when stacked in a pallet. Unvented bags will form unstable stacks.

When the bag is to have the tamper evident structure of the first embodiment, both films, that is the rear wall film and the front wall film, are each in a first step perforated above the slide zipper reclosable seal and the films sealed together at an upper edge. When the tamper evident structure is of the further embodiment, neither film is perforated and the slide zipper reclosable seal is bonded to the top of the top edge of these films which comprise the front and rear walls.

The bag in a first embodiment is opened by severing the perforations in the area above the slide zipper seal to expose the slide zipper seal which is the primary seal. The zipper then is opened and product removed. The bag is resealed after removing a portion of the product by closing the slide zipper seal. In the further embodiment the bag is opened by opening the zipper and then severing a film seal that extends downward into the bag from the slide zipper seal.

DETAILED DESCRIPTION OF THE INVENTION

The present bag is unique in that it is a side gusset bag with a slide zipper reclosable seal. It also has a tamper-evident seal feature as well as a venting to equalize pressure within and outside of the bag. In addition, the bag has a bottom fill construction that provides for faster fill cycle time since only one seal has to be made after filling a bottom seal. If top filled, the slide zipper seal closure would have to be closed and then the front wall and rear wall ends extending above the slide zipper seal bonded together. These are two distinctly different operations that would have to be conducted on the bag. Additionally the further embodiment cannot be top filled.

Figure 1:
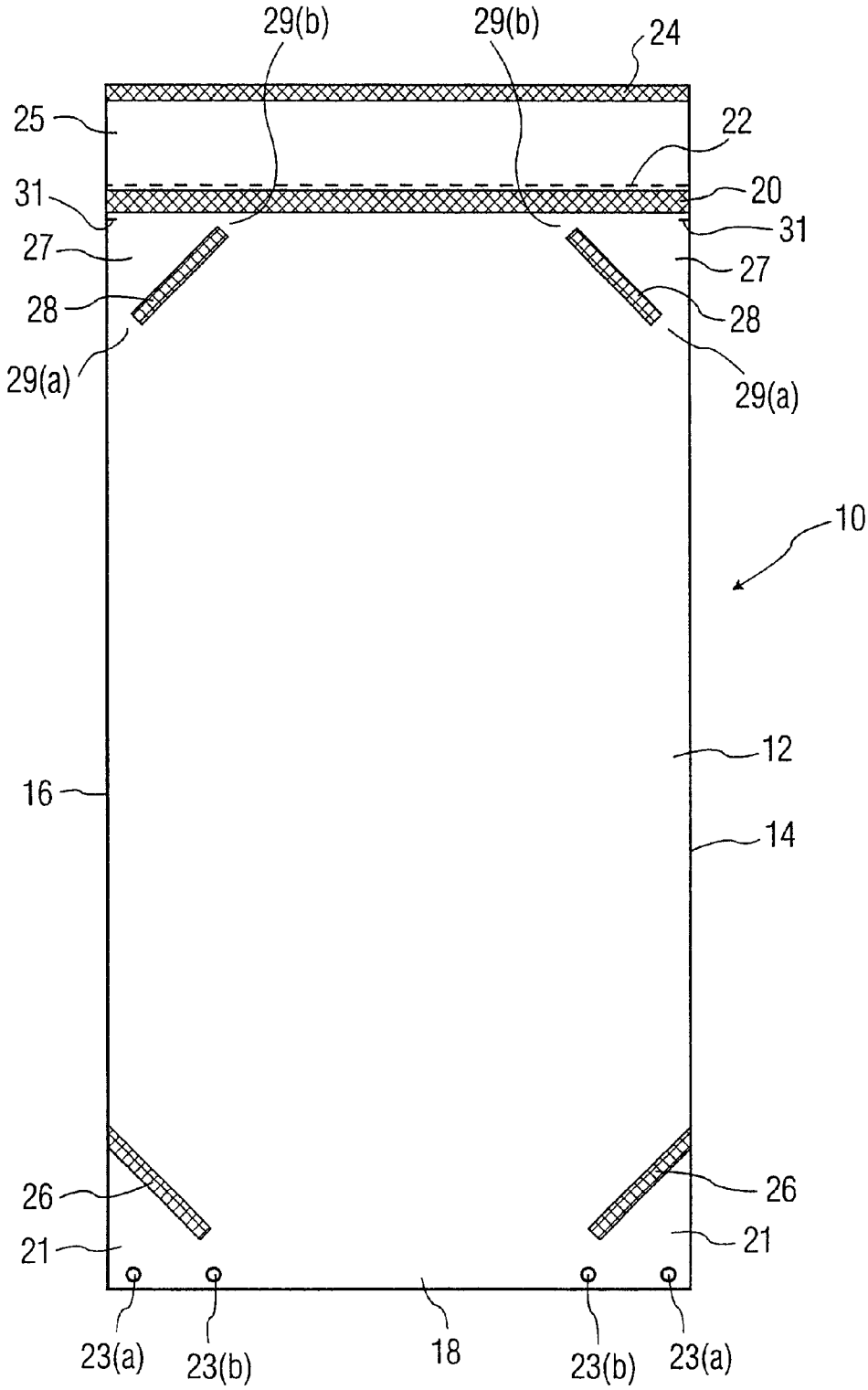
FIG. 1 is an elevation view of the bag formed but not filled.

FIG. 1 shows the bag unfilled in a front elevation view. The bag 10 has a front wall 12 from a first film and sidewalls 14 and 16. These are gusset sidewalls. The bottom 18 of the bag is open for the bag to be bottom filled. Adjacent the bottom are areas 21 which are removed from the volume of the bag by seals 26 and which assist in forming the flat bottom to the bags. The flat bottom allows the bags to stand on end. At the upper end of the bag there is a seal 20. This seal is a seal of the front wall and the rear wall (from a second film) to a slide zipper closure and the rear wall to the sidewall gussets. At the ends of the slide zipper closure the closure is bonded to the gusset sidewalls. Above this seal 20 there is a perforation 22 and above this perforation a seal 24 of the front wall and rear wall together. Between seal 20 and seal 24 there is an area 25. This structure with the front and rear wall extending above the slide zipper seal closure forms the tamper-evident seal. The slide zipper closure cannot be opened until this structure is removed.

Located below seal 20 are diagonal seals 28 which form volume areas 27 which are removed from the bag volume. Opening 29(*a*) and 29(*b*) between the seals 28 and the sidewalls 14, 16 keep product away from the slide zipper seal ends and also provide for venting of the bag. Sidewalls 14, 16 have an opening 31 to the exterior of the bag. This venting provides a way for the air pressure within the bag to equalize with air pressure outside of the bag. The seals 26 and 28 are substantially diagonal-like in alignment being angled from the edges of the sidewalls and front and rear walls. Further, the seals 26 bond the gusset sidewalls to the front and rear walls to assist in forming a flat bottom to the bag.

Located at the base are tack seals 23(*a*) that tack the gusset fold to the front wall or rear wall, and preferably to the rear wall. This will keep the sidewall gusset structure away from the filler tube during bag filling. Also located at the base of the bag arc tack seals 23(*b*) of the rear wall to the front wall. This is through aligned apertures in the gusset sidewall whereby the inner surface of the front wall can contact the inner surface of the rear wall.

Figure 2:
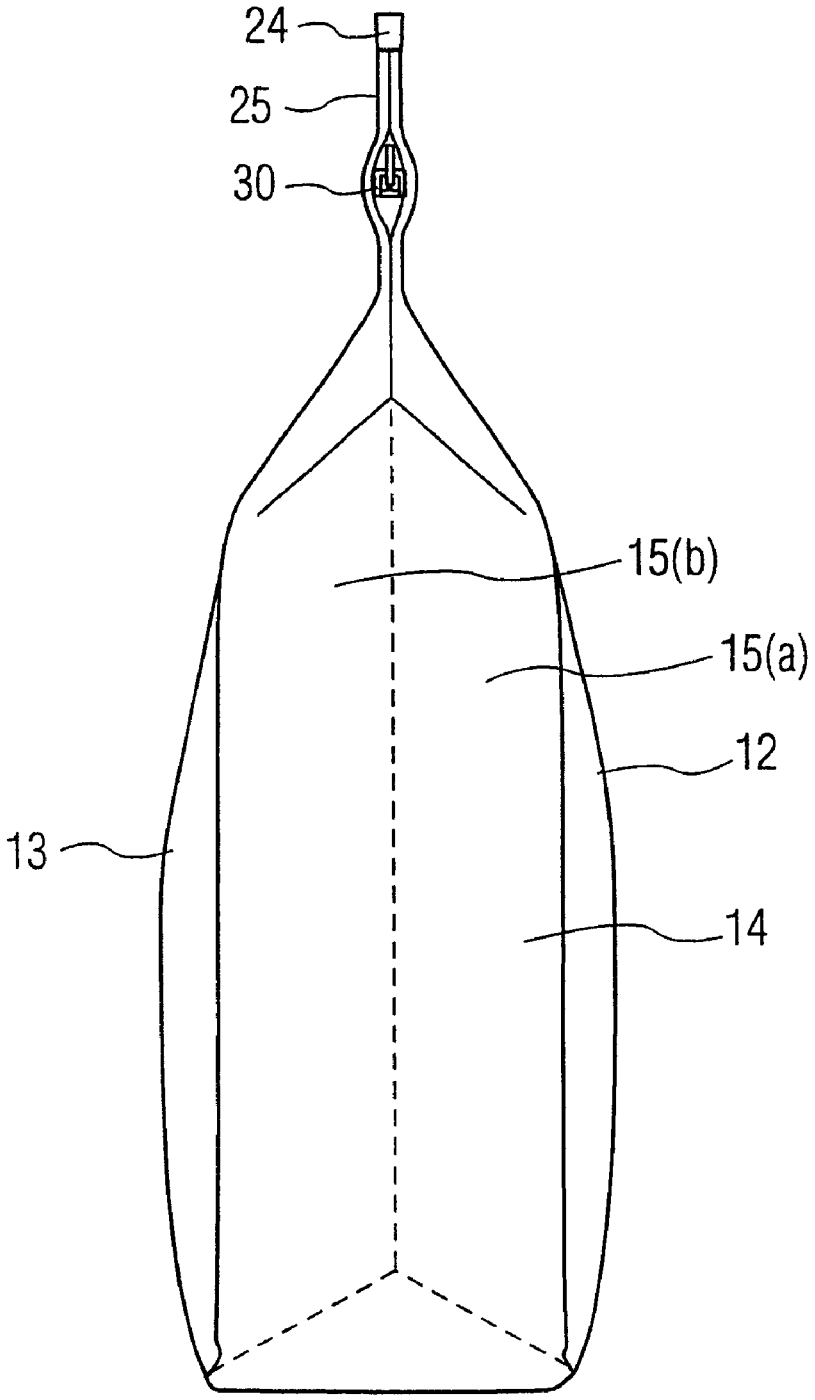
FIG. 2 is a side elevation view of the bag showing the sidewall gussets.

FIG. 2 is a side elevation view of the filled and sealed bag showing the rear wall 13 and expanded gusset walls 15(*a*) and 15(*b*) of sidewall 14. First gusset wall 15(*a*) is attached to front wall 12 and second gusset wall 15(*b*) is attached to rear wall 13. The bag is shown as supported on a flat surface. The gusset structure forms a flat bottom surface so that the bag can stand upright.

Figure 3A:
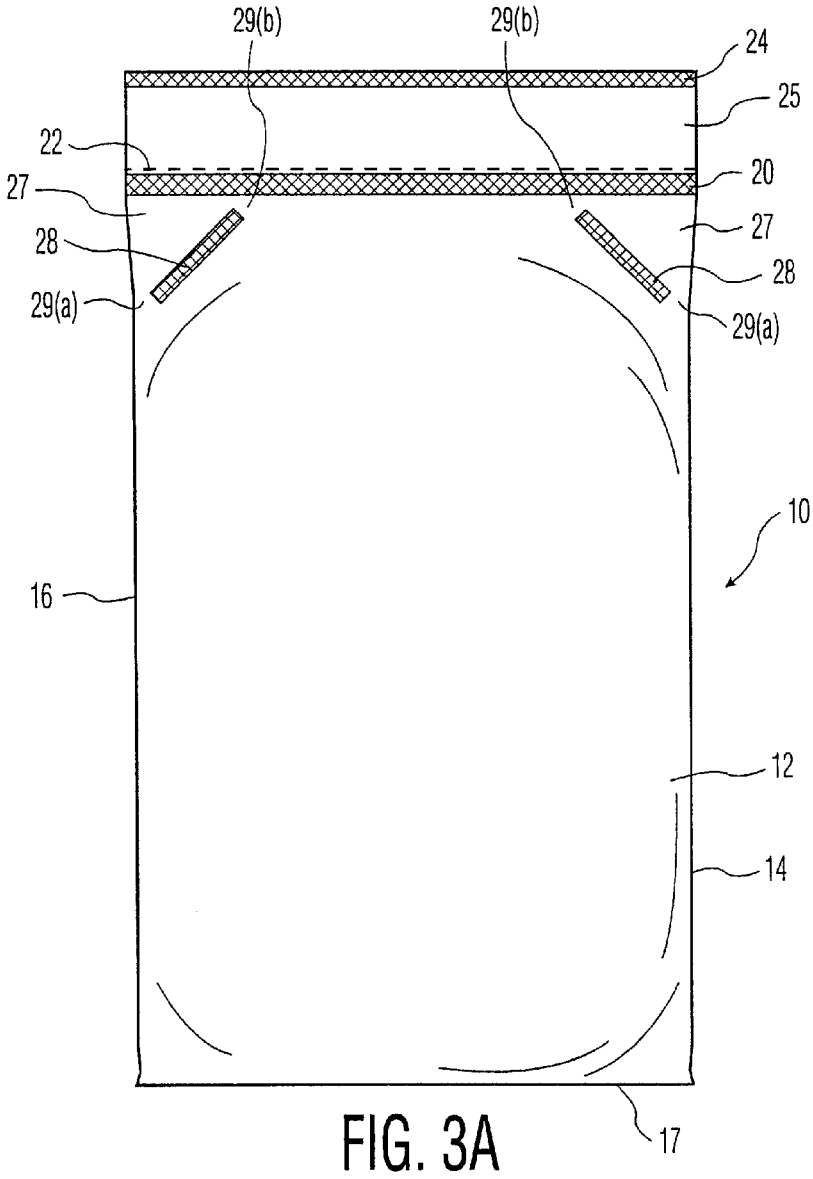
FIG. 3A is a front elevation view of the bag filled.
Figure 3B:
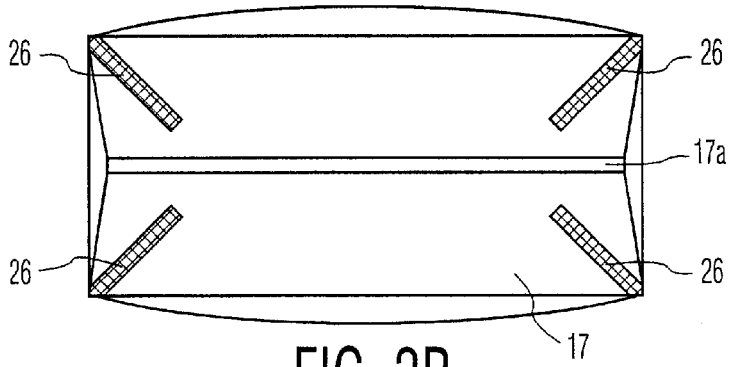
FIG. 3B is a bottom plan view of the bag filled.

FIG. 3A is a front elevation view of the bag filled and sitting on a flat surface. The gusset structure allows the bottom of the bag to expand to a flat platform 17 to therefore support the bag. FIG. 3B is a bottom plan view of the bag of FIG. 3A.

Figure 4:
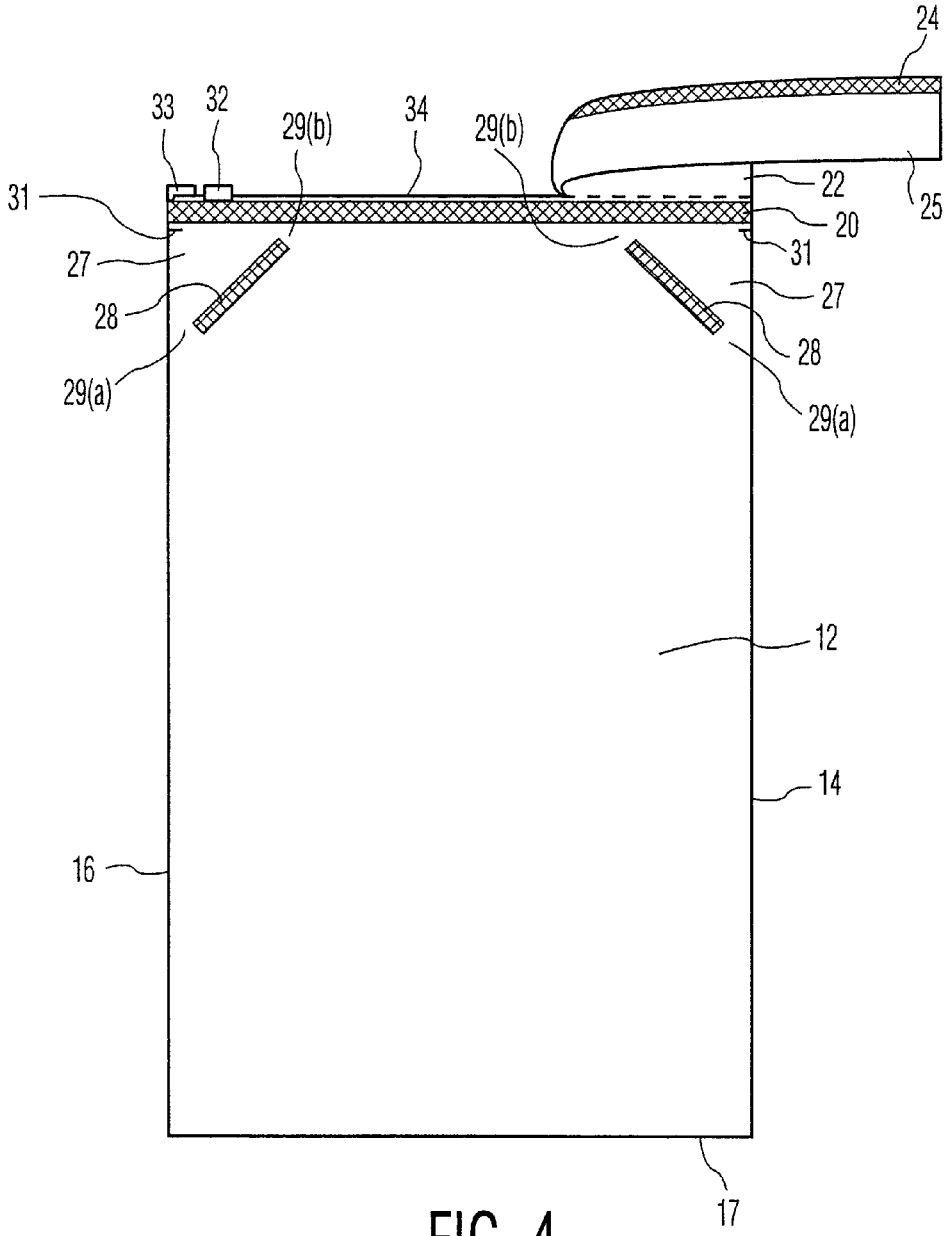
FIG. 4 is a front elevation view of the bag filled and partially opened.

FIG. 4 is the bag being opened. The section 25 above seal 20 is remove at perforations 22 to expose the slide zipper seal comprised of interfitting slot and rib 34 and a slider 32 to open and close the rib and slot arrangement of the slide zipper closure. When the slider 32 is moved in one direction it opens the interfitting slot and rib structure and when moved in the reverse direction it fits the slot and rib structure together to seal the bag. Up to this point section 25 has functioned as a tamper-evident seal.

Figure 5:
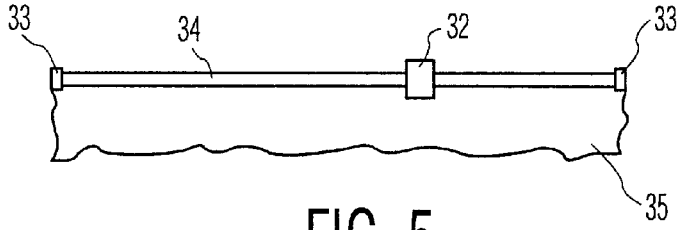
FIG. 5 is a top plan view of a slide zipper seal.

FIG. 5 shows modifications for the ends of the slide zipper closure. The closure 30 at the ends have added stop pieces 33 bonded to the zipper. These added stop pieces widen the slide zipper closure 30 at the ends to be greater than the slider cross-section thereby preventing the slider from being accidentally removed from the zipper. A sealing fin 35 attaches the slide zipper closure to the bag inner surface by heat bonding. The seal fin 35 also can be attached to the outer surface.

Figure 6:
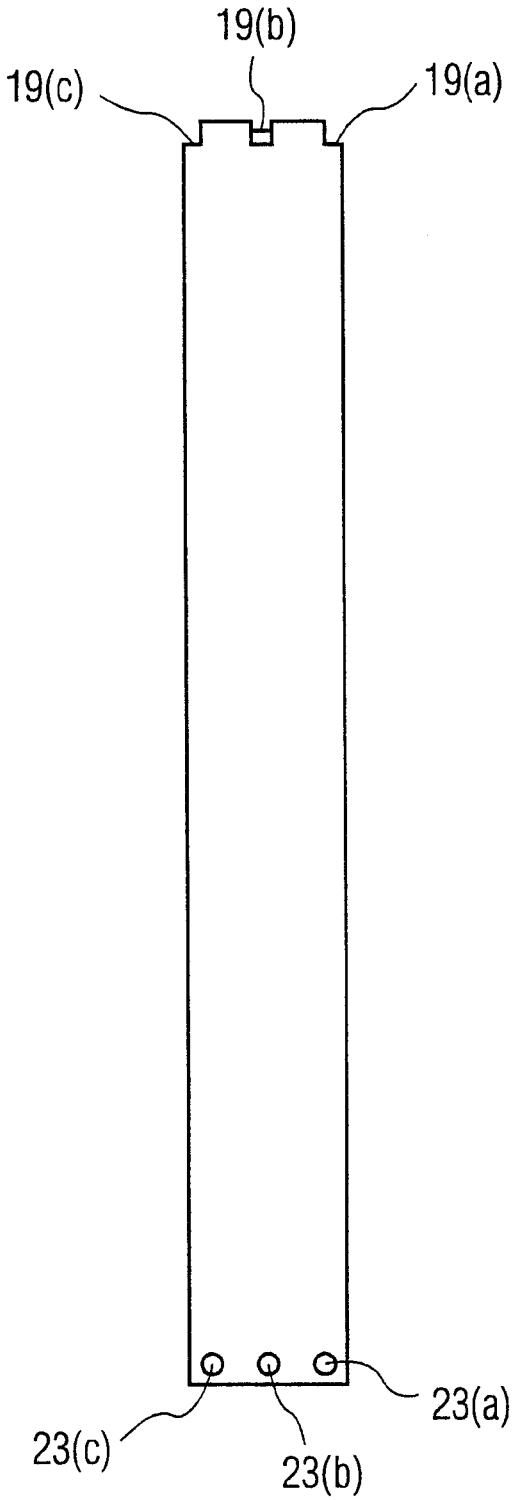
FIG. 6 is a elevational view of a bag having an alternate slide zipper reclosable seal.

FIG. 6 is a top plan view of a gusset sidewall cylinder prior to attachment to a front or rear wall of a bag. In making the gusset sidewall a sheet of film is formed into a cylinder. The cylinder in FIG. 2 is shown as laying flat and has cutouts 19(*a*), 19(*b*) and 19(*c*) at the top edge and apertures 23(*a*) and 23(*b*) at the bottom. Cutouts 19(*a*) and 19(*c*) can provide for an attachment of the front and rear wall to the slide zipper closure and 19(*b*) a vent for the bag. Aperture 23(*a*) is through two plies of the cylinder . Aperture 23(*b*) only is through the top ply. The upper cutouts are through two plies.

Figure 7:
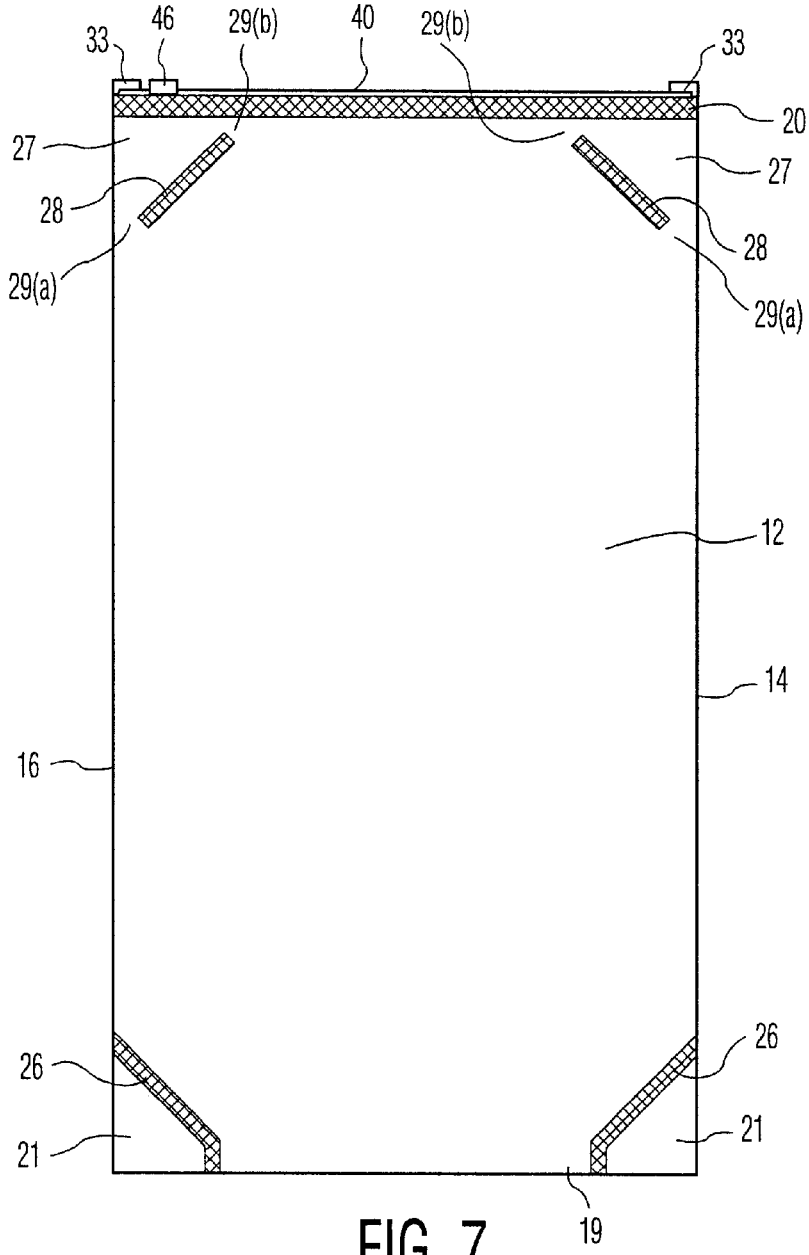
FIG. 7 is a cross-sectional view of the slide zipper reclosable seal of FIG. 6.

FIG. 7 discloses an alternate structure for the bag. The filled bag is essentially the same except for the tamper evident structure. In this embodiment the tamper evident structure is in the bag below the zipper rather than on the exterior above the zipper. Consequently, in this structure the zipper 40 with slider 46 forms the top of the bag.

Figure 8:
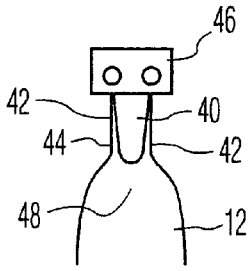
FIG. 8 is a schematic diagram of a process for making the first embodiment of the reclosable bag.

This zipper structure of FIG. 7 is shown in FIG. 8 in cross-section. The zipper 40 is comprised of mating surfaces 42 and 44 and slider 46. The mating surfaces have downwardly extending fins for attaching the zipper to the front wall 12 and rear wall 13. Extending downward from each of these fins is tamper evident film 48 which extends down into the bag. When the zipper is first opened the tamper evident film still maintains the bag interior separate from the exterior. The tearing of the film removes the tamper evidency and the contents of the bag can be dispensed.

The bags shown in FIGS. 1 to 4 can be made in several ways. It is preferred that the bag ends move in the machine direction as the bag is made with the gusset sidewalls added in the cross-direction. However, the gussets and slide zipper reclosable seal can move in the machine direction and the front and rear walls in a cross direction. The bags are made in a running length with the bags separated, one from the other, in a final step.

Figure 9:
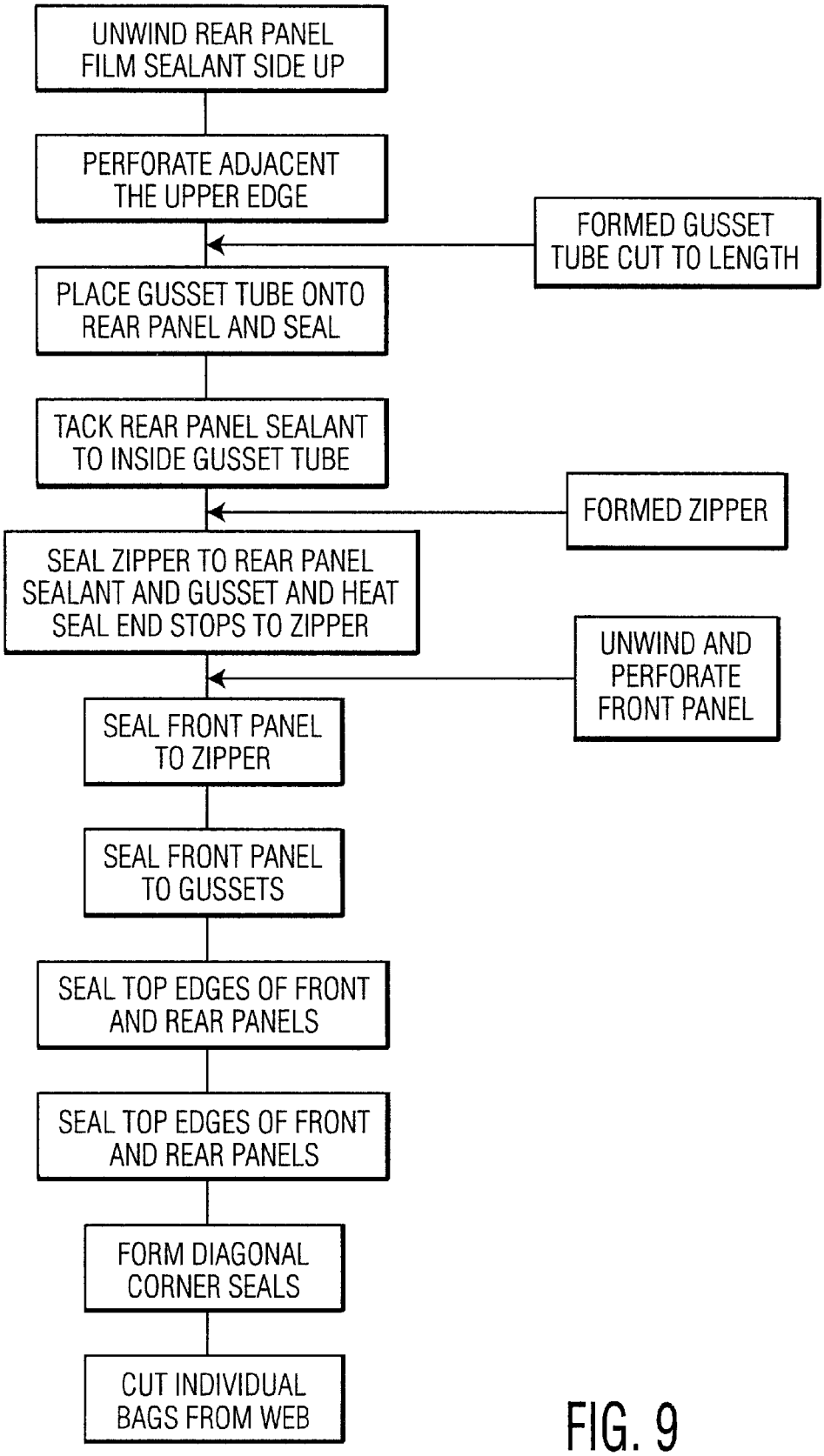
FIG. 9 is a schematic diagram of a process for making the bag.

A schematic process for making the bags is set out in FIG. 9. This Figure sets out the preferred technique for making the reclosable bag having the first embodiment tamper evident structure The gusset sidewalls and the zipper preferably are formed off-line. In forming the gusset sidewall film is unwound from a roll and formed into a tube. Four essentially opposite holes are cut at the bottom edge of what is to be the bottom of a sidewall and the tubes are flattened and cut to length. The cutouts 19(*a*), 19(*b*) and 19(*c*) are formed at an upper end of the cylinder. These holes allow for a bond of an inner surface of the rear wall to be bonded to the inner surface of the front wall and a tacking of the gusset to the front or rear wall. At the same time a zipper stock is unwound from a roll, the zipper closed, and a slider attached to the closed zipper.

On the main bag line a film roll stock is unwound with the side having a sealant facing upward. The sealant usually will be a layer of a thermoplastic. This second film, which will be the bag back wall, is perforated adjacent the edge that is to be the upper edge of the bag. The gusset tubes then are overlayed in a cross-direction on this back wall film spaced to be equivalent to the width of a bag, and sealed onto the back wall film. The width of the seal is equivalent to about double the width of the seal of the side seal of the finished bag.

In the next step the back wall film is tacked to the inside of the gusset tube through the elongated holes. This will keep the gusset end adjacent the rear wall when the bag is finished and ready for filling with a product. This is followed by indexing the formed zipper onto the upper part of the back wall below the perforation and sealing this zipper to the back wall film. In a preferred embodiment end stops are heat sealed onto the zipper adjacent the seal of the gusset tube to the rear wall film. These stops will prevent the zipper slider from being removable from the zipper.

In the next step a front wall first film is unwound from a roll and perforated along the edge that is to be the upper edge and which will overlay the perforation on the back wall film. The front wall first film then is attached to the zipper in the machine direction and to the gusset wall in the cross-direction. This is followed by sealing the top edge of the front and rear wall together to complete the tamper evidency structure.

The diagonal seals that will be adjacent each comer of the bag then are formed and the films cut to form individual bags. The bags then are printed, bottom filled and the bottom edge sealed. The bag is opened by the consumer by removing the upper part of the bag along the perforation and then opening the zipper.

The bag of FIG. 5 has a different zipper structure which allows for the elimination of the perforated cover over the zipper. This bag of FIG. 5 is made in the same way as the bag of FIGS. 1–4 except that the zipper is attached to the upper edge of the front and rear walls rather than recessed down on these walls . Otherwise the bag making processes are essentially the same. Further, this bag is bottom filled and sealed as is the bag of FIGS. 1–4.

The front wall, rear wall and gusset side walls can be constructed of a monolayer or a multilayer plastic laminate structure. A multilayer plastic laminate structure is preferred since then the bag can be customized for particular uses. Different layers can provide strength to the bag and/or barrier properties. However, the inner surfaces of the bag should be thermoplastic so that they also can function as seal layers. These layers will usually be a polyene such as a polyethylene, a polypropylene or a specialized plastic such as a metalacene. However, essentially any bondable thermoplastic can be used.

The bags can be formed in essentially any size. Usually the bags will be formed in sizes to contain about five to about one hundred pounds of a product, and usually about ten to fifty pounds. The bags during shipping can readily be palletized and due to the pressure equalization structure with the atmosphere, will not be affected by altitude changes. Additionally bags of this structure will have less head space which enhances the palletizing of the bags. Further, due to the gusset sidewall structure, the bag will stand on the bottom surface without having to be supported by a wall or other structure.

The present bags can be modified in various ways but yet be within the concepts described herein. All such variations are considered to be within the present invention.

What is claimed is:

1. A reclosable bag comprising a front wall, a rear wall and a first and a second sidewall, each said first sidewall and said second sidewall connecting the front wall to the rear the front wall and of the rear wall closed by a slide zipper reclosable seal, the front wall and the rear wall bonded together at an end opposite the reclosable seal, the bond comprising a bond of the front wall to the rear wall over a medial portion thereof, end portions thereof comprising a seal of the front wall and rear wall to a sidewall gusset wherein the front wall and the rear wall are bonded together in the area of the gussets to form a region that is removed from the volume of the bag at each corner of the bag adjacent the reclosable seal, a vent to the exterior of the reclosable bag in the region that is removed from the volume of the reclosable bag whereby pressure can be equalized from within the reclosable bag to the exterior thereof.

2. A reclosable bag as in claim 1 wherein the front wall and the rear wall are bonded together at said end portions to form a region that is removed from the volume of the bag at each corner of the bag distant from said reclosable seal.

3. A reclosable bag as in claim 1 wherein the bond of the front wall and the rear wall adjacent the reclosable seal comprises a bond of the front wall to the first wall of the gusset of the sidewall, the first wall of the gusset being bonded to the second wall of the gusset, and the second wall of the gusset being bonded to the rear wall.

4. A reclosable bag as in claim 1 wherein a portion of each of the front wall and the rear wall of said reclosable bag extends above said reclosable seal and are sealed together to provide a tamper evident seal for the reclosable bag.

5. A reclosable bag as in claim 4 wherein there is a tamper evident seal located within said reclosable bag below said fastener.

6. A reclosable bag as in claim 5 wherein said fastener is a zipper, wherein said zipper has a stop bonded to each end thereof.

7. A reclosable bag as in claim 1 wherein said reclosable seal has a stop bonded to at least one end thereof.

8. A reclosable bag as in claim 7 wherein said reclosable seal has a stop bonded to each end thereof.

9. A reclosable bag as in claim 8 wherein a portion of each of the front wall and the rear wall of said reclosable bag extends above said reclosable seal and are sealed together to provide a tamper evident seal for the reclosable bag.

* * * * *